United States Patent [19]

Wesenberg

[11] 4,047,324

[45] Sept. 13, 1977

[54] BALLOON AND PARACHUTE TOY

[76] Inventor: Hans Ulrich Wesenberg, D-8506, Langen-Kirchfembach-37, Germany

[21] Appl. No.: 666,626

[22] Filed: Mar. 15, 1976

[30] Foreign Application Priority Data

Nov. 26, 1975 Germany ..... 2555296

[51] Int. Cl.[2] ..... A63H 33/20

[52] U.S. Cl. ..... 46/86 R

[58] Field of Search ..... 46/86, 87, 88

[56] References Cited

U.S. PATENT DOCUMENTS

| | | | |
|---|---|---|---|
| 1,512,492 | 10/1924 | Segeberg | 46/86 R |
| 2,321,904 | 6/1943 | Frazier | 46/86 R |

FOREIGN PATENT DOCUMENTS

| | | | |
|---|---|---|---|
| 2,255,906 | 5/1974 | Germany | 46/86 R |

*Primary Examiner*—Louis G. Mancene
*Assistant Examiner*—Robert F. Cutting
*Attorney, Agent, or Firm*—Ross, Ross & Flavin

[57] ABSTRACT

A flying toy has a body, an inflatable balloon connected to a downwardly facing nozzle, and a recess accommodating a parachute. Upon inflation, the escape of air from the balloon causes the toy to rise, and as the balloon reaches the end of its deflation, its reduction in size uncovers the recess to allow deployment of the parachute to enable the toy to float back to earth.

7 Claims, 6 Drawing Figures

1
1'
2
3
4
5
6
7
8
9
10
11
12
13
14
15
16
17
18
19
20
21
22
S

BALLOON AND PARACHUTE TOY

The invention relates to a flying toy which can "fly" or ascend under its own volition and float back to earth. Such a toy can have the shape of a rocket flier or a parachutist or, if desired, can carry advertising. A body of the toy is of a light material, preferably a plastics foam such a styrofoam, and is equipped with an inflatable air balloon. An inflation nozzle for the balloon is arranged so that its longitudinal axis passes through the center of gravity of the body and faces downwardly in normal flight attitude. The force to cause the toy to rise is provided by the compressed air in the balloon escaping through the nozzle, which force is kept greater than the force of gravity acting on the entire toy.

When the toy has reached its greatest height, i.e. the balloon is almost empty, it returns comparatively quickly to the ground with an increasing rate of descent.

This type of return to ground is not true to reality when the flying object is, for example, designed as a replica of a rocket flier or of a parachute jumper, because these float slowly back to earth.

The invention provides a flying toy including a body (for example in the form of a rocket flier or a parachutist), an inflatable balloon having an inflation nozzle (which nozzle passes through the toy center of gravity and, in the normal flight attitude, faces vertically downwardly, the force acting on the toy during deflation of the balloon being greater than the force of gravity acting on the toy), a parachute, and a recess, facing the balloon, for housing the parachute when folded (the balloon, in its inflated condition, serving to retain the folded parachute in the recess and, upon deflation, allowing the parachute to leave the recess and open).

Advantageously, the parachute is of extremely thin plastics film so that its weight is as samll as possible and so that the parachute, after reaching the greatest height of climb, rapidly opens. It is also particularly favorable if the parachute lines are integral with the rest of the parachute, inasmuch as a one-piece parachute will exhibit no twisting of its lines.

If the toy is designed as a rocket flier, having a backpack and an extension representing an air intake, it is advisable to provide the recess on the extension.

The toy when in the form of a rocket flier, can ascend by means of the inflatable air balloon and can float to earth on the parachute. During the ascent, the extremely light parachute is accommodated in a folded state in the recess, that part of the balloon facing the recess retains the parachute in the recess. As the balloon deflates, the recess is progressively exposed. Finally, when the toy has ceased rising, the parachute leaves the recess and opens out to retard the subsequent descent so that the toy floats to the ground.

Tests have shown first, that the ascent of the toy is virtually unhindered by the folded parachute, and second, that the floating of the flying body caused by the parachute is not hindered by the empty balloon.

In constructional respects, it has proved to be favorable for the parachute to be in the shape of a polygon, more especially a hexagon, and for the lines to emanate from the corners of the polygon. It is true that by such production, with the lines in one piece, a relatively great deal of waste exists, but the need for a connection of the ropes to the parachute is obviated.

It is important that the balloon, which holds the parachute in its folded position during ascent, is not thrust aside by the folded parachute. In this case, there would emerge an unsteady disturbed flight. Therefore, the recess which is provided on the flying object is necessary and easily receives the folded parachute and which is closed by the inflated balloon and freed upon deflation of the balloon.

Figures 1, 2, 3, 4, 5, 6:
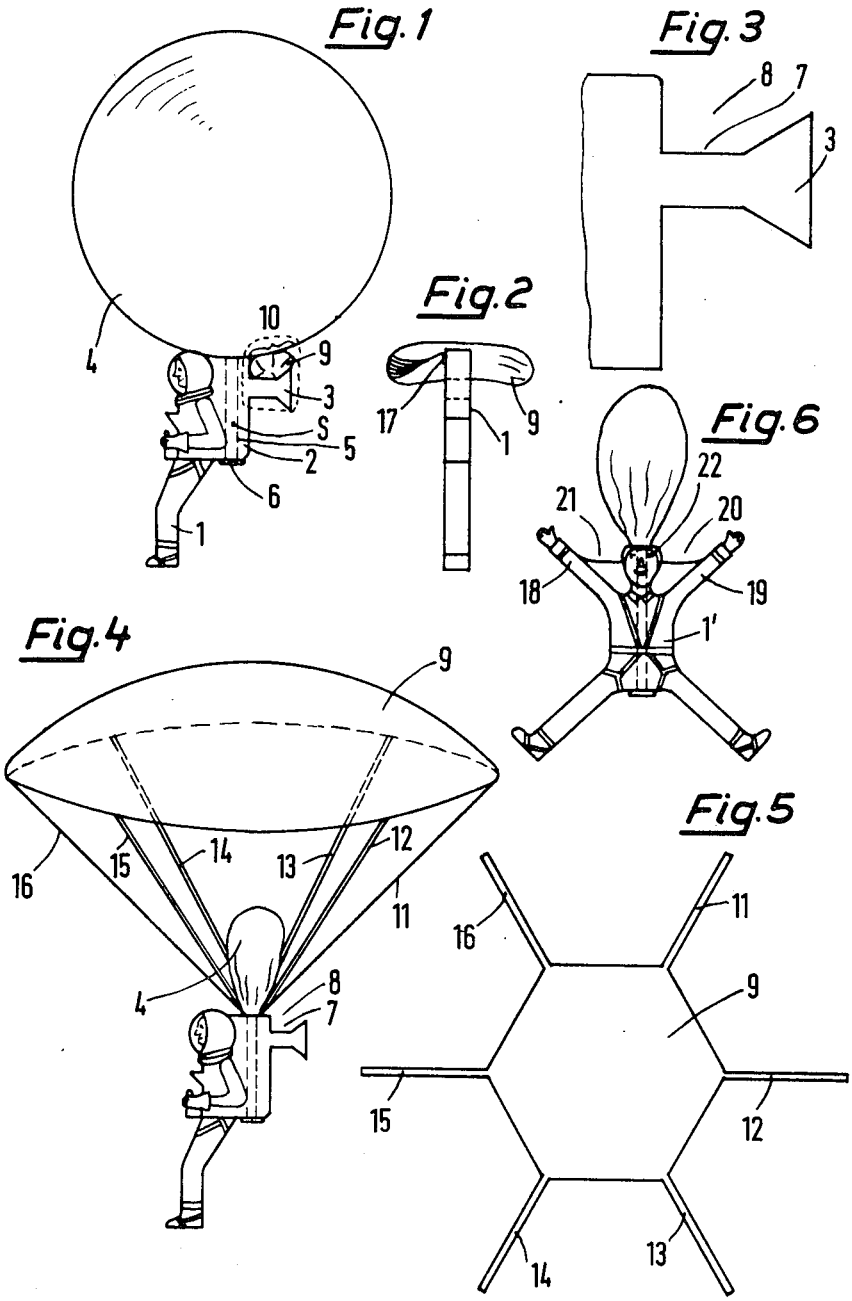
FIG. 1 shows in a side elevational view a first preferred embodiment of the invention, in the form of a rocket flier.
FIG. 2 shows in a front view the FIG. 1 toy, a balloon of the toy having been omitted for clarity.
FIG. 3 is an enlarged view of the part framed in broken lines in FIG. 1, without a parachute.
FIG. 4 shows the toy of FIG. 1 with its parachute opened and its balloon deflated.
FIG. 5 shows a parachute blank, showing the integral lines.
FIG. 6 shows a second embodiment of the invention, shaped to resemble a parachutist.

In FIG. 1, I show a preferred embodiment of the toy of the invention which represents a rocket flier. A body 1 of the flier is of light weight material, for example styrofoam or other polystyrene. Mounted on body 1 is an imitation backpack 2, containing the rocket propulsive unit having an air intake 3. The toy is provided with an inflatable balloon 4 of rubber or rubber-like material. An inflation nozzle 5 of the balloon passes as an elongate bore through backpack 2. The mouthpiece 6 faces the ground, that is downwardly, in the normal flight attitude of the toy.

The air intake 3 and the body of the flier between them define a recess 7 whose outer side 8 faces balloon 4. Recess 7 serves for the reception of a folded parachute 9. A part 10 of the wall of the inflated balloon 4 forms a closure for the recess to retain the folded parachute in recess 7 when balloon 4 is inflated, as will be seen from FIG. 1. The part 10 opens the top 8 of the recess 7 when the balloon 4 deflates due to the expulsion of the air out through aperture or mouthpiece 6.

The parachute 9 is formed from an extremely thin plastics film. In the embodiment shown, the parachute 9, as is evident from FIG. 5, defines a hexagonal canopy. The lines 11 to 16, which emanate from the corners of the canopy and connect it to body 1 of the flier, are integral with the canopy, their free ends being fastened to the body 1 for example by an adhesive connection 17.

The toy is designed so that the longitudinal axis of the inflation nozzle 5 leads through the center of gravity S of the toy. When released in the attitude of FIG. 1, the force exerted on the toy by the escaping air acts vertically upwardly.

When the balloon 4, toward the end of the ascent of the toy, deflates sufficiently, as for instance to the FIG. 4 condition, the part 10 of the balloon no longer blocks the recess 7 so that the parachute 9 slides out and opens, as shown in FIG. 4. Consequently, the toy floats slowly back to earth.

In FIG. 6, the toy has a body in the form of a parachutist 1', and his arms 18 and 19 project freely upwardly. A space 20 or 21 between the head 22 and the arm 18 or 19 respectively constitutes a recess in each instance. Alternatively, the parachutist could also carry the folded parachute on his back, as in reality. To this end, there can be on the back of the parachutist a replica of a parachute backpack which forms an upwardly-open recess which faces the balloon and which serves for the reception of the folded parachute.

I claim:

1. A balloon and parachute toy comprising: a balloon which can be inflated by air, a missile, such as a rocket aviator, parachutist or the like, and a parachute, the balloon having a mouthpiece the longitudinal axis of which passes through the center of gravity of the missile, with the mouthpiece aperture facing the ground in the normal flight position of the missile, the missile having a trough opening which opens towards the balloon for receiving the folded parachute, a portion of the balloon facing the trough acting as a cover for automatically opening and closing the trough whereby the balloon, in its inflated condition, serves to retain the folded parachute in the recess and, upon deflation, allows the parachute to leave the recess and open, and wherein the dimensioning of parts is such that the force of recoil of the air escaping from the inflated balloon is greater than the force of gravity which acts on the missile and the attached balloon and parachute.

2. A toy as claimed in claim 1, wherein the parachute has a canopy of thin plastics film.

3. A toy as claimed in claim 2, wherein lines of the parachute are integral with the canopy.

4. A toy as claimed in claim 2, wherein the canopy is polygonal, a line emanating from each corner thereof.

5. A toy as claimed in claim 4, wherein the canopy is hexagonal.

6. A toy as claimed in claim 1, and having a missile representing a rocket flier equipped with a propulsion backpack, the backpack and an extension representing an air intake of the propulsion unit defining the trough.

7. A toy as claimed in claim 1, and having a missile representing a parachutist, the trough being defined by the rear of the head and arms of the missile.

* * * * *